US006009581A

United States Patent [19]

Davis et al.

[11] Patent Number: 6,009,581

[45] Date of Patent: Jan. 4, 2000

[54] SCRAPING TOOL HAVING A TOOL SOCKET AND INTEGRAL WRENCHES

[76] Inventors: Dave D. Davis; M. Shane Davis, both of P.O. Box 39071, Denver, Colo. 80239

[21] Appl. No.: 09/082,677

[22] Filed: May 21, 1998

[51] Int. Cl.[7] ..... B44C 7/00

[52] U.S. Cl. ..... 7/105; 7/158; 7/169

[58] Field of Search ..... 7/105, 138, 165, 7/158, 169

[56] References Cited

U.S. PATENT DOCUMENTS

| | | | |
|---|---|---|---|
| D. 279,514 | 7/1985 | Grunz . | |
| D. 293,951 | 1/1988 | Harvey . | |
| D. 327,553 | 6/1992 | Gringer . | |
| 3,461,469 | 8/1969 | Morrision | 7/165 X |
| 4,200,948 | 5/1980 | Nesseth . | |
| 4,281,433 | 8/1981 | Sendoykas . | |
| 4,553,279 | 11/1985 | Gassew et al. . | |
| 4,984,324 | 1/1991 | Farris . | |
| 5,020,181 | 6/1991 | Leonard . | |
| 5,095,573 | 3/1992 | Henke et al. . | |
| 5,272,782 | 12/1993 | Hutt . | |
| 5,440,777 | 8/1995 | Olivieri . | |
| 5,720,063 | 2/1998 | Chacon | 7/105 X |
| 5,870,786 | 2/1999 | Papadopoulos | 7/105 |

FOREIGN PATENT DOCUMENTS

| | | |
|---|---|---|
| 0 003 379 | 8/1979 | European Pat. Off. . |
| WO 96/16586 | 6/1996 | WIPO . |

*Primary Examiner*—James G. Smith

[57] ABSTRACT

A scraping tool for use with a paint sprayer assembly includes a scraping tool having a tool socket and a number of integral wrenches. In a preferred embodiment the scraping tool includes three cutouts for accommodating various sized nuts and a triangular protrusion extending from the scraping edge for scraping in tight spaces. A tool socket is provided near an end of the handle of the scraping tool for receiving various tool heads. In a most preferred embodiment, the scraper tool is designed for use in association with a particular paint spraying machine such that the scraper tool provides the necessary wrenches and tools for operating and maintaining the paint spraying machine.

14 Claims, 2 Drawing Sheets

SCRAPING TOOL HAVING A TOOL SOCKET AND INTEGRAL WRENCHES

BACKGROUND OF THE INVENTION

1. Field of the Invention

The present invention relates to scraping tools and more particularly pertains to a new scraping tool having a tool socket and a number of wrenches for use with a paint sprayer assembly.

2. Description of the Prior Art

The use of scraping tools is known in the prior art. More specifically, scraping tools heretofore devised and utilized are known to consist basically of familiar, expected and obvious structural configurations, notwithstanding the myriad of designs encompassed by the crowded prior art which have been developed for the fulfillment of countless objectives and requirements.

Known prior art scraping tools include U.S. Pat. No. 4,200,948; U.S. Pat. No. 5,095,573; U.S. Pat. No. 5,020,181; U.S. Pat. No. 4,984,324; U.S. Pat. No. 5,440,777; and U.S. Pat. No. D279,514.

While these devices fulfill their respective, particular objectives and requirements, the aforementioned patents do not disclose a new scraping tool. The inventive device includes a new scraping tool having a tool socket and a number of wrenches.

In these respects, the scraping tool according to the present invention substantially departs from the conventional concepts and designs of the prior art, and in so doing provides an apparatus primarily developed for the purpose of use with a paint sprayer assembly.

SUMMARY OF THE INVENTION

In view of the foregoing disadvantages inherent in the known types of scraping tools now present in the prior art, the present invention provides a new scraping tool construction wherein the same can be utilized for use with a paint sprayer assembly.

The general purpose of the present invention, which will be described subsequently in greater detail, is to provide a new scraping tool apparatus and method which has many of the advantages of the scraping tools mentioned heretofore and many novel features that result in a new scraping tool which is not anticipated, rendered obvious, suggested, or even implied by any of the prior art scraping tools, either alone or in any combination thereof.

To attain this, the present invention generally comprises a new scraping tool having a tool socket and a number of wrenches.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new scraping tool apparatus and method which has many of the advantages of the scraping tools mentioned heretofore and many novel features that result in a new scraping tool which is not anticipated, rendered obvious, suggested, or even implied by any of the prior art scraping tools, either alone or in any combination thereof.

It is another object of the present invention to provide a new scraping tool having a tool socket and a number of wrenches which may be easily and efficiently manufactured and marketed.

It is a further object of the present invention to provide a new scraping tool which is of a durable and reliable construction.

An even further object of the present invention is to provide a new scraping tool which is susceptible of a low cost of manufacture with regard to both materials and labor, and which accordingly is then susceptible of low prices of sale to the consuming public, thereby making such scraping tool economically available to the buying public.

Still yet another object of the present invention is to provide a new scraping tool which provides in the apparatuses and methods of the prior art some of the advantages thereof, while simultaneously overcoming some of the disadvantages normally associated therewith.

Still another object of the present invention is to provide a new scraping tool having a tools socket and a number of wrenches for use with a paint sprayer assembly.

Yet another object of the present invention is to provide a new scraping tool which includes a tool socket and a number of wrenches for use with a paint sprayer assembly.

Still yet another object of the present invention is to provide a new scraping tool that can be used in combination with an existing paint sprayer to provide integral wrenches for adjusting the paint sprayer.

Even still another object of the present invention is to provide a new scraping tool that has a leading scraping surface suitable for scraping a variety of surfaces. Particularly those surfaces which might be otherwise difficult to reach using a conventional scraper, such as a first surface that meets a second surface at an acute angle.

Even yet another object of the present invention is to provide a sturdy scraper for durability and long term use.

Yet a further object of the present invention is to provide a scraper tool which has a substantially triangular protrusion proximate the scraping surface to facilitate scraping around detail work and other places which are hard to reach using a conventional prior art scraper.

Still yet another object of the present invention is to provide a scraper tool in which the scraping plate extends the length of the handle to provide better weight balance and durability.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
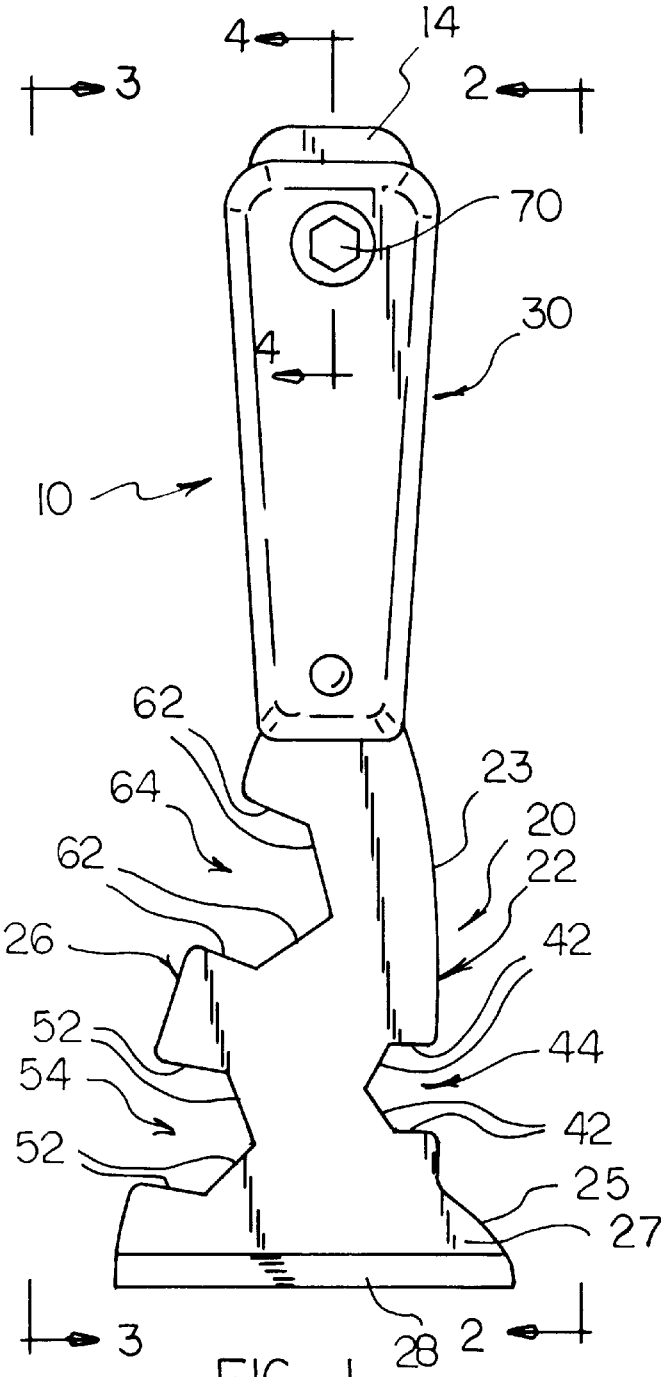
FIG. 1 is a schematic front view of a new scraping tool according to the present invention.
Figure 2:
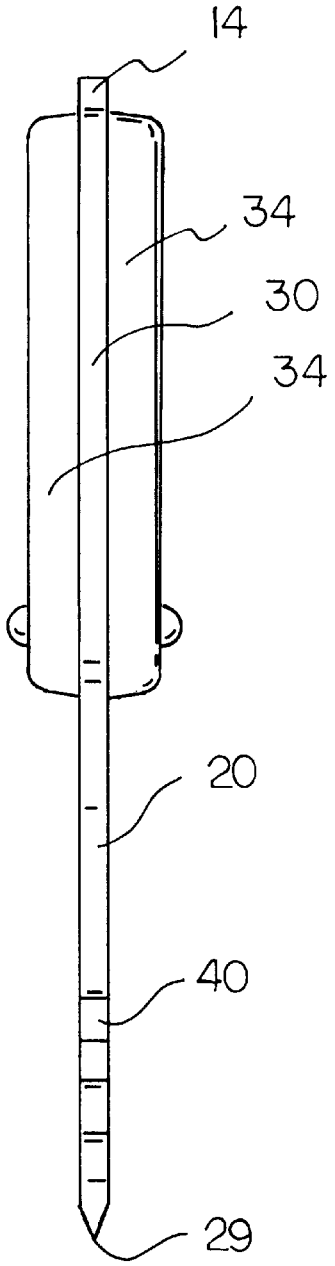
FIG. 2 is a schematic right side view of the present invention.
Figure 3:
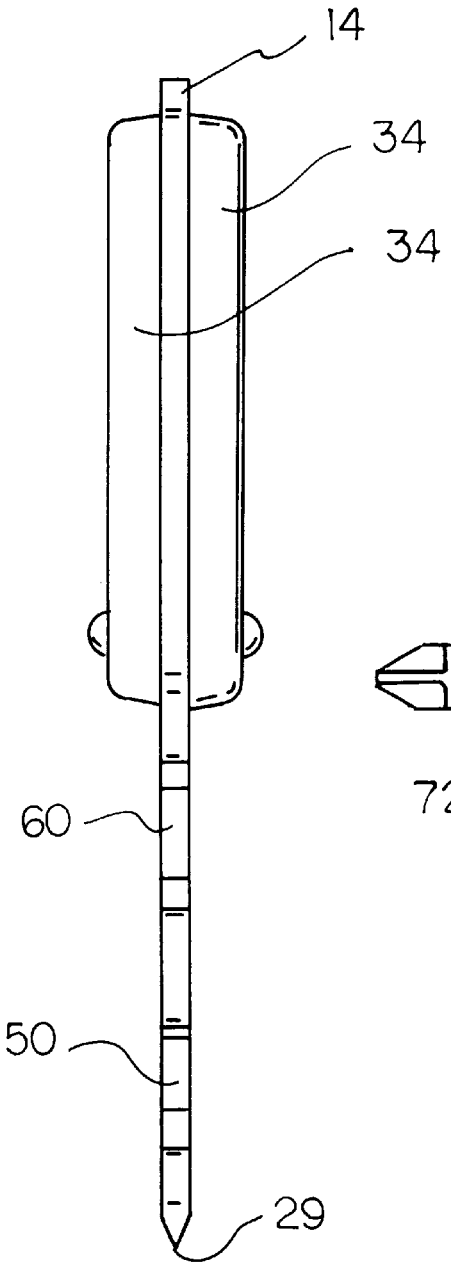
FIG. 3 is a schematic left side view of the present invention.

With reference now to the drawings, and in particular to FIGS. 1 through 4 thereof, a new scraping tool embodying the principles and concepts of the present invention and generally designated by the reference numeral 10 will be described.

As best illustrated in FIGS. 1 through 4, the scraping tool 10 includes a substantially planar plate member 12 which is preferably rigid. The plate member 12 is divided into a scraper portion 20 and a handle portion 30. The scraper portion 20 has a first side surface 22, a second side surface 26 and a scraping surface 28 that extends between the first side surface 22 and the second side surface 26. Preferably, the scraper surface 28 has a beveled tip 29.

The first side surface 22 is divided into a first region 23 extending from the handle portion 30 of the plate member 12, and a second region 25 extending outwardly from the first region 23 towards the scraping surface 28. Thus, the scraping surface 28 and the second region 25 form a generally triangular protrusion 27 for scraping in areas difficult to reach using a broad scraping tool while still providing a broad scraping surface 28.

The scraper portion 20 generally has a number of cutouts but preferably has three cutouts 40, 50, and 60 respectively. The first cutout 40 has four first cutout sides 42 to accommodate a conventional hexagonal nut. Two of the first cutout sides 42 are positioned substantially parallel to each other to define a first cutout space 44 corresponding to an appropriate sized hexagonal nut. The first cutout is preferably disposed within the first region 23 of the first side surface 22.

The second cutout 50 also has four second cutout sides 52 to accommodate a hexagonal nut. Two of the second cutout sides 52 are preferably positioned substantially parallel to each other to define a second cutout space 54 wider than the first cutout space 44 and corresponding to a different sized hexagonal nut. The second cutout 50 is preferably disposed from the second side surface 26 of the scraper portion 20.

The third cutout 60 again has four third cutout sides 62 to accommodate a hexagonal nut. Two of the third cutout sides 62 being positioned substantially parallel to each other to define a third cutout space 64 wider than the second cutout space 54 and corresponding to a third size of hexagonal nut. The third cutout is preferably disposed from the second side surface 26 of the scraper portion 20 between the handle portion 30 and the second cutout 50.

In a most preferred embodiment, the scraper tool 10 is designed for use in association with a paint sprayer tool so that the first cutout 40 is designed to engage a hose connector nut of the paint sprayer, the second cutout 50 is designed to engage a second sized hose connector nut, and the third cutout 60 is designed to engage a tip assembly nut.

The handle portion 30 of the plate member 12 has an aperture 32 positioned proximate a plate member end 14. A pair of handle members 34 are coupled on either side of the handle portion 30. Each of the handle members 34 has a hole 36 aligned with the aperture 32 in the handle portion 30 to permit a fastener 38 therethrough.

Figure 4:
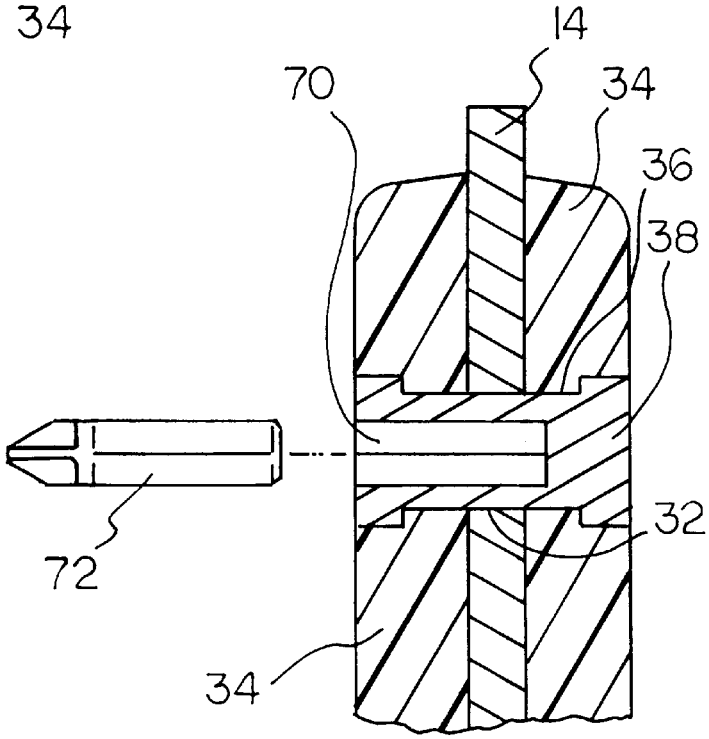
FIG. 4 is a schematic cross sectional view of the present invention taken along line 4—4 in FIG. 1.

A socket 70 designed to engage a variety of tool heads, such as tool head 72 in FIG. 4, is positioned within the fastener 38.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A scraping tool comprising:

a substantially planar plate member, said plate member having a scraper portion and a handle portion;

a number of cutouts along an outside surface of said scraper portion of said plate member, each of said cutouts being adapted to engage a nut;

a handle coupled to said handle portion of said plate member;

said handle portion of said plate member having an aperture positioned proximate a plate member end opposite said scraper surface;

a pair of handle members coupled on either side of said handle portion;

each of said handle portions having a hole aligned with said aperture in said handle portion; and a socket receptor positioned within a fastener, said fastener passing through each handle hole and said aperture, said socket receptor being adapted to receive a tool head.

2. The scraping tool of claim 1 wherein said plate member is rigid.

3. The scraping tool of claim 1 further comprising:

said scraper portion having a first side surface, a second side surface and a scraping surface, said scraping surface extending between said first side surface and said second side surface.

4. The scraping tool of claim 3 wherein said scraper surface is beveled.

5. The scraping tool of claim 3 further comprising:

said first side surface having a first region extending from said handle portion of said plate member, said first side surface further having a second region extending outwardly from said first region such that said second region and said scraper surface form a generally triangular protrusion.

6. The scraping tool of claim 5 further comprising:

one of said number of cutouts being a first cutout disposed from said first region of said first side surface of said scraper portion.

7. The scraping tool of claim 6 further comprising:

said first cutout having four first cutout sides, two of said first cutout sides being positioned substantially parallel to each other to define a first cutout space therebetween.

8. The scraping tool of claim 5 further comprising:

said number of cutouts being three;

a first cutout being disposed from said first region of said first side surface of said scraper portion;

a second cutout being disposed from said second side surface of said scraper portion; and a third cutout being disposed from said second side surface of said scraper portion.

9. The scraping tool of claim 8 wherein said first cutout includes four first cutout sides, two of said first cutout sides being positioned substantially parallel to each other to define a first cutout space therebetween;

said second cutout includes four first cutout sides, two of said second cutout sides being positioned substantially parallel to each other to define a second cutout space therebetween; and said third cutout includes four third cutout sides, two of said third cutout sides being positioned substantially parallel to each other to define a third cutout space therebetween.

10. The scraping tool of claim 9 further comprising:

said second cutout space being wider than said first cutout space; and said third cutout space being wider than said second cutout space.

11. The scraping tool of claim 1 wherein each cutout includes four cutout sides, two of said cutout sides being positioned substantially parallel to each other to define a space therebetween.

12. The scraping tool of claim 1 wherein said socket receptor is hexagonal in shape.

13. A scraping tool for use with a paint spraying machine, said paint spraying machine being of the type having a tip assembly, a spray hose, and hose connectors, said scraping tool comprising:

a substantially planar plate member, said plate member being rigid, said plate member having a scraper portion and a handle portion;

said scraper portion having a first side surface, a second side surface and a scraping surface, said scraping surface extending between said first side surface and said second side surface, said scraper surface being beveled;

said first side surface having a first region extending from said handle portion of said plate member, said first side surface further having a second region extending outwardly from said first region to form a generally triangular protrusion;

said scraper portion having a first cutout, said first cutout having four first cutout sides, two of said first cutout sides being positioned substantially parallel to each other to define a first cutout space therebetween and being disposed from said first region of said first side surface of said scraper portion;

said scraper portion having a second cutout, said second cutout having four second cutout sides, two of said second cutout sides being positioned substantially parallel to each other to define a second cutout space therebetween and being disposed from said second side surface of said scraper portion;

said scraper portion having a third cutout, said third cutout having four third cutout sides, two of said third cutout sides being positioned substantially parallel to each other to define a third cutout space therebetween and being disposed from said second side surface of said scraper portion;

said second cutout space being wider than said first cutout space;

said third cutout space being wider than said second cutout space;

said first cutout adapted to engage a nut of said hose connector;

said second cutout being adapted to engage a nut of one of said hose connectors;

said third cutout being adapted to engage a nut of said tip assembly;

said handle portion of said plate member having an aperture positioned proximate a plate member end opposite said scraper surface;

a pair of handle members coupled on either side of said handle portion;

each of said handle members having a hole aligned with said aperture in said handle portion;

a socket receptor positioned within a fastener, said fastener passing through each handle hole and said aperture, said socket receptor being adapted to receive a tool head.

14. A scraping tool comprising:

a substantially planar plate member, said plate member having a scraper portion and a handle portion;

a number of cutouts along an outside surface of said scraper portion of said plate member, each of said cutouts being adapted to engage a nut;

a handle coupled to said handle portion of said plate member;

said handle portion of said plate member having an aperture positioned proximate a plate member end opposite said scraper surface;

a pair of handle members coupled on either side of said handle portion;

each of said handle portions having a hole aligned with said aperture in said handle portion; and a socket receptor passing through each handle hole and said aperture, said socket receptor being adapted to receive a tool head.

* * * * *